US005209022A

United States Patent [19]

McCambridge

[11] Patent Number: 5,209,022

[45] Date of Patent: May 11, 1993

[54] EDGE SHARPENING OR SURFACE ABRADING APPARATUS

[75] Inventor: James E. McCambridge, Polo, Ill.

[73] Assignee: Wahl Clipper Corporation, Sterling, Ill.

[21] Appl. No.: 819,031

[22] Filed: Jan. 10, 1992

[51] Int. Cl.[5] ..... B24B 23/00

[52] U.S. Cl. ..... 51/181 R; 51/170 T; 51/170 TL

[58] Field of Search ..... 51/170 R, 170 T, 170 TL, 51/181 R, 173

[56] References Cited

U.S. PATENT DOCUMENTS

| | | | |
|---|---|---|---|
| 1,337,890 | 4/1920 | Dorthen | 51/170 TL |
| 2,332,613 | 10/1943 | Swank | 51/170 TL |
| 3,007,230 | 11/1961 | Riedl | 51/170 TL |
| 4,128,970 | 12/1978 | Sawrenko | 51/170 TL |
| 5,022,189 | 6/1991 | Saul | 51/170 TL |

FOREIGN PATENT DOCUMENTS

| | | | |
|---|---|---|---|
| 0256608 | 3/1949 | Switzerland | 51/170 TL |

*Primary Examiner*—Roscoe V. Parker
*Attorney, Agent, or Firm*—Welsh & Katz, Ltd.

[57] ABSTRACT

Apparatus for sharpening blade edges or abrading surfaces includes a handle and an abrasive device such as a sharpening stone secured to the handle for reciprocating motion with respect to the handle. The stone is secured to a drive arm which extends into the handle. The drive arm is secured in the handle for reciprocating motion by a pair of spaced pivot bearings. A motor having an offset shaft end oscillates an L-shaped lever inside the handle. The L-shaped lever pivots about a shaft. A load arm of the lever extends through an opening in the drive arm which is between the spaced pivot bearings. Oscillation of the L-shaped lever causes oscillation of the load arm about the shaft, which in turn causes reciprocation of the drive arm and sharpening stone. The sharpening stone moves a selected stroke distance, which is determined by, among other things, the distance between the shaft and the opening in the drive arm. The drive arm is flexible, so that when the load on one side of the stone is increased, the stroke is decreased, and when the load on the other side of the stone is increased, the stroke is also increased. As the stroke increases in this manner, the speed of the stone increase, and as the stroke decreases, the power or torque increases and the speed of the stone decreases.

10 Claims, 2 Drawing Sheets

EDGE SHARPENING OR SURFACE ABRADING APPARATUS

This invention relates to blade sharpening or surface abrading apparatus, and more particularly, to reciprocating blade sharpening or surface abrading apparatus having a variable stroke which changes according to load conditions, changing the torque and speed of the sharpening or abrading device. This invention also relates to blade sharpening or surface abrading apparatus which produces reciprocating, rotating and oscillating motion in separate abrasive devices using a single motor.

BACKGROUND OF THE INVENTION

Stones and grinding wheels have been used for many years to abrade surfaces or sharpen knife blades, fish hooks, hatchets, broad head arrows and other edged devices that require a sharp edge. The edge or surface is rubbed against the stone by hand, or the grinding wheel is turned by a motor to sharpen the edge or abrade the surface. Hand sharpening is slow, and most grinding wheels are bulky and inconvenient to use. Thus, there is a need for edge sharpening apparatus which is small, inexpensive and convenient to use.

Accordingly, one object of this invention is to provide new and improved edge sharpening or surface abrading apparatus.

Another object is to provide new and improved reciprocating blade sharpening or surface abrading apparatus having a variable stroke, speed and torque which change according to load conditions.

Still another object is to provide new and improved edge sharpening or surface abrading apparatus which is not bulky, is inexpensive and convenient to use.

Yet another object is to provide new and improved edge sharpening or surface abrading apparatus which produces reciprocating, rotating and oscillating motion in separate abrasive devices using a single motor.

SUMMARY OF THE INVENTION

In keeping with one aspect of this invention, apparatus for sharpening edges or abrading surfaces includes a handle, and an abrasive device such as a sharpening stone secured for reciprocating motion with respect to the handle. The stone is secured to a drive arm which extends into the handle. The drive arm is secured in the handle for reciprocating motion by a pair of spaced pivot bearings.

A motor having an offset shaft end oscillates an L-shaped lever inside the handle. The L-shaped lever pivots about a shaft. A load arm of the lever extends through an opening in the drive arm, the opening being between the spaced pivot bearings. Oscillation of the L-shaped lever causes oscillation of the load arm about the shaft, which in turn causes reciprocation of the drive arm and sharpening stone.

The sharpening or surface abrading stone moves a selected stroke distance, which is determined by, among other things, the distance between the shaft and the opening in the drive arm. The drive arm is flexible, so that when the load on one side of the stone is increased, the stroke is decreased, and when the load on the other side of the stone is increased, the stroke is also increased. As the stroke increases in this manner, the speed of the stone increases, and as the stroke decreases, the speed of the stone also decreases, and the torque increases.

BRIEF DESCRIPTION OF THE DRAWINGS

The above mentioned and other features of an embodiment of this invention and the manner of obtaining them will become more apparent, and will be best understood by reference to the following description, taken in conjunction with the accompanying drawings, in which.

DETAILED DESCRIPTION

Figure 5:
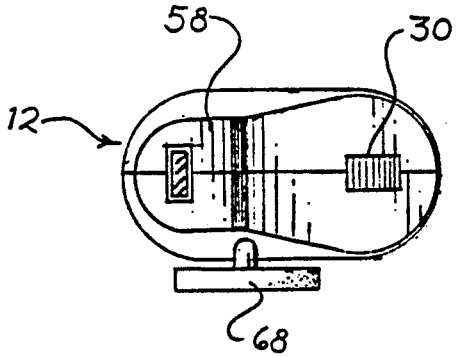
FIG. 5 is a top cross-sectional view of the apparatus of FIG. 1 as fully assembled, taken along lines 5—5 in FIG. 1.
Figure 1:
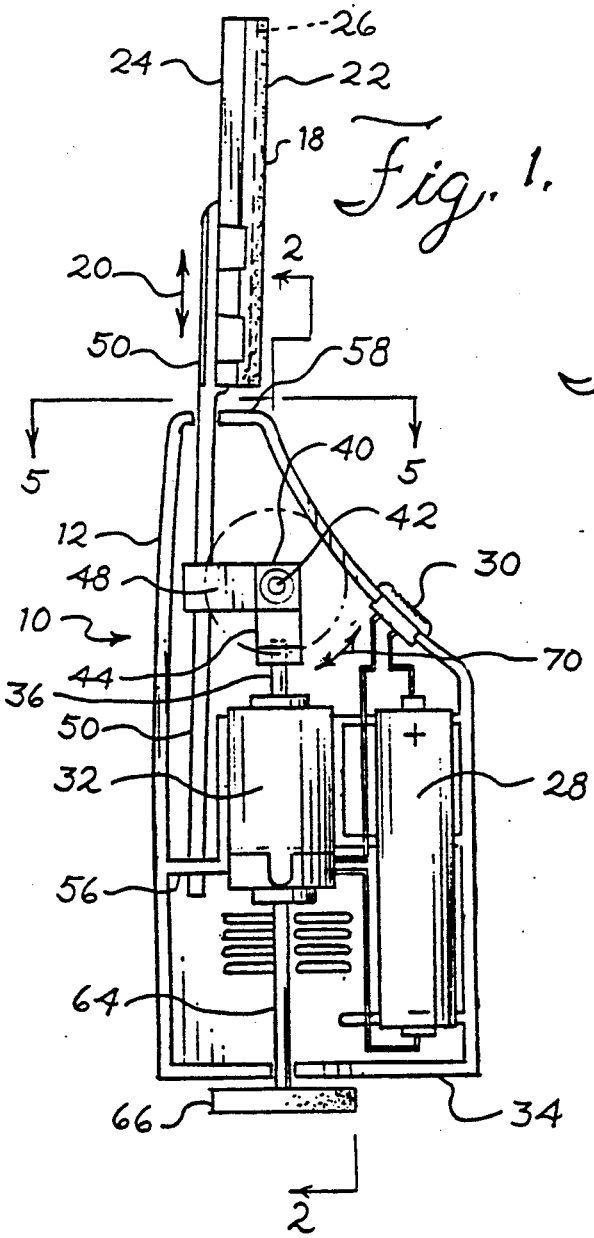
FIG. 1 is a front view of the internal parts of apparatus made in accordance with this invention.
Figure 2:
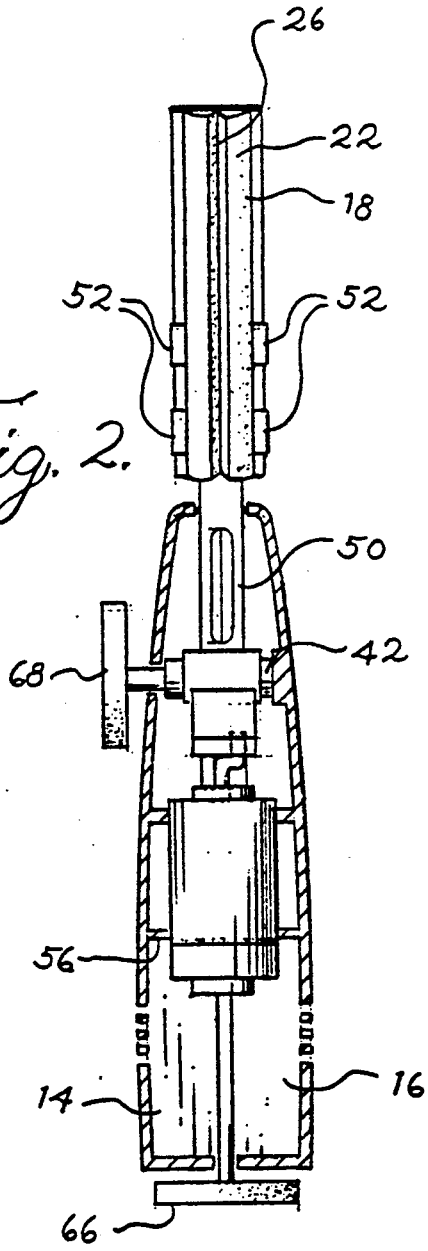
FIG. 2 is a side cross-sectional view of the apparatus of FIG. 1 taken along lines 2—2.

As seen in FIG. 1, apparatus 10 includes a handle 12 having two pieces 14 and 16 (FIG. 2). The pieces 14, 16 can be assembled with snaps or any other suitable means.

A cutting or abrasive medium 18, such as a sharpening stone, is secured to the handle 12 for reciprocating movement in the direction of arrows 20. The abrasive medium or stone 18 includes a first sharpening surface 22, and a second sharpening surface 24. The sharpening surface 22 may be rounded if desired, or flat, and may include a longitudinal groove 26, for sharpening fishing hooks.

The handle 12 includes a compartment for a battery 28, an on/off switch 30 and a motor 32. The motor 32 is powered by the battery 28 and controlled by the switch 30. The battery is inserted and removed by removing a battery access door 34 in the bottom of the handle 12.

Figure 3:
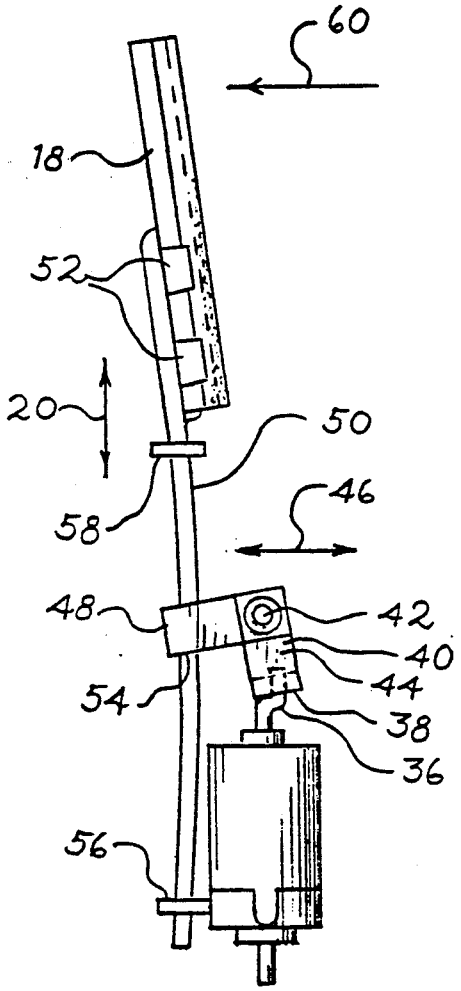
FIG. 3 is a front view of the drive mechanism and reciprocating abrasive medium of the apparatus of FIG. 1.

The motor 32 includes a shaft having an offset end 36 (FIG. 3). The offset shaft end 36 fits into an opening 38 in a pivot arm 40. The pivot arm 40 is an L-shaped member which pivots on a shaft 42. The pivot arm 40 includes a drive arm 44 which moves in the directions 46, and a load arm 48 which is approximately perpendicular to the drive arm 44. Reciprocating motion 46 occurs in a direction substantially parallel with a centerline of the motor 32.

The sharpening stone 18 is secured with respect to the handle 1 by a flexible drive arm 50. The stone 18 may be secured to the drive arm 50 by any suitable means, such as a plurality of fingers 52. The drive arm 50 includes an opening 54 through which the load arm 48 fits so that the drive arm 50 moves in the direction of the arrows 20 when the motor 32 is on. That is, rotation of the offset shaft end 36 moves the pivot arm 40 in the directions 46, which in turn moves the load arm 48 and the drive arm 50 in the directions of the arrows 20. The drive arm 50 moves in a reciprocating manner.

The drive arm 50 is secured within the handle 12 by a drive arm bottom bearing 56 (FIG. 1) and a drive arm top bearing 58. The bearings 56, 58 secure the drive arm 50 from lateral movement in the housing, without significantly restricting its reciprocating movement in the direction of the arrows 20.

The stroke distance of the stone 18 is related to the distance between the arm 50 at the opening 54, where the arm 50 is driven, and the shaft 42. The arm 50 is preferably made of a strong yet flexible material, so that when a load is pressed against the surface 22 or the surface 24, the arm 50 flexes a desired amount between the bearings 56 and 58, depending on the size of the load or restriction, such as a side wall of the handle 12 which can be adapted to limit the amount of side pivot movement of the drive arm 50. When pressure is placed against the surface 22, in the direction of arrow 60, the load arm 50 pivots at the bearings 56, 58, and flexes so that the opening 54 moves closer to the shaft 42. This movement reduces the stroke distance of the load arm 50, and also increases the torque or power transmitted to the abrasive medium 18. The speed of the medium 18 is reduced under these conditions.

Figure 4:
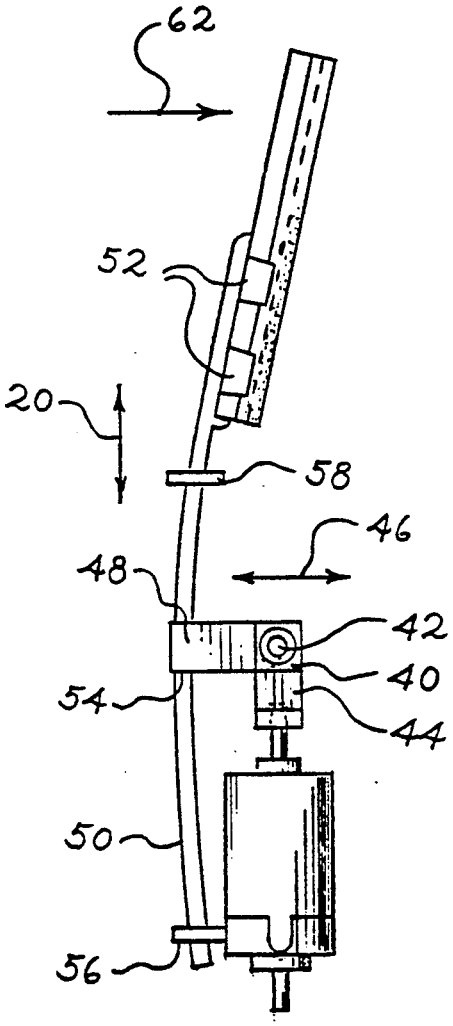
FIG. 4 is another front view of the drive mechanism and reciprocating abrasive medium of the apparatus of FIG. 1.

A load placed against the surface 24, in the direction 62 in FIG. 4, causes the load arm 50 to flex away from the shaft 42 at the opening 54, increasing the stroke distance of the load arm 50 while decreasing the power and increasing the speed of the medium 18.

The bottom end 64 of the shaft of the motor 32 can include a circular cutting, grinding or polishing medium 66, such as a grinding wheel, which is rotated by the motor 32. In addition, an abrasive medium 68, which may also be a grinding or polishing wheel, may be secured to the shaft 42. The wheel 68 oscillates in the direction of arrows 70 (FIG. 1) since the centerline of the shaft 42 is allowed to oscillate when the pivot arm 40 moves.

In use, the stone 18 sharpens the edges of fish hooks, blades and the like by reciprocating across the blade edge, while the abrasive medium 66 operates by rotational movement, and the abrasive medium 68 operates through oscillating movement All three motions are obtained from a single power source, the motor 32.

The many advantages of this invention are now apparent. The speed and power transmitted to the reciprocating stone can be adjusted by changing the load placed against the stone, and a reciprocating stone, a rotating wheel and an oscillating wheel are all provided in one apparatus, all driven by a single drive means. The apparatus can be hand-held, and can be inexpensively made and conveniently used.

While the principles of the invention have been described above in connection with specific apparatus and applications, it is to be understood that this description is made only by way of example and not as a limitation on the scope of the invention. For example, the reciprocating drive mechanism may be used in hair clippers, electric knives, power saws, polishing devices and the like.

What is claimed is:

1. An apparatus having a medium for abrading or sharpening a surface comprising:

a flexible drive member operatively coupled to the medium and reciprocally secured by a plurality of bearing means to facilitate a stroke by said flexible drive member;

a pivot arm pivotal about a shaft and operatively coupled to said flexible drive member, said pivot arm further positioned so as to lie between said plurality of bearing means;

drive means, operatively coupled to said pivot arm, for driving said flexible drive member in a reciprocating motion, wherein said flexible drive member is pivotal about said plurality of bearing means in response to a force applied to said flexible member and said stroke varies in response to said applied force.

2. The apparatus of claim 1 wherein said drive means is a motor and said reciprocating motion occurs in a direction substantially parallel with a centerline of said motor.

3. The apparatus of claim 2 wherein said flexible drive member includes an opening adapted to slidably engage said pivot arm such that applying a side force to said flexible drive member causes said opening to slide about said pivot arm.

4. The apparatus of claim 3 wherein said pivot arm is substantially "L"-shaped and said motor includes a rotatable shaft having an offset end for engaging said pivot arm.

5. The apparatus of claim 2 wherein said stroke decreases when a side force is applied to said flexible drive member so as to cause said flexible drive member to pivot toward said shaft.

6. The apparatus of claim 2 wherein said stroke increases when a side force is applied to said flexible drive member so as to cause said flexible drive member to pivot away from said shaft.

7. The apparatus of claim 1 further comprising a handle adapted to limit the amount of lateral pivot movement of said flexible drive member.

8. The apparatus of claim 1 further comprising another medium operatively coupled to said pivot arm such that said other medium oscillates while said flexible drive member reciprocates.

9. The apparatus of claim 1 further including a rotating medium operatively coupled to said drive means wherein said drive means is a motor with one end of a rotatable shaft for coupling to said pivot arm and another end of said rotatable shaft for rotating said rotating medium at another end of said rotatable shaft.

10. An apparatus having a moving medium for abrading or sharpening a surface comprising:

rotating medium;

a pivot arm, operatively coupled to said moving medium, for moving said medium in an oscillating motion; and drive means with a rotatable shaft having an offset end for coupling to said pivot arm and an opposing end for rotatably driving said rotating medium, such that said drive means facilitates oscillating movement of said moving medium and rotating movement of said rotating medium.

* * * * *

UNITED STATES PATENT AND TRADEMARK OFFICE

CERTIFICATE OF CORRECTION

PATENT NO. : 5,209,022

DATED : May 11, 1993

INVENTOR(S) : James E. McCambridge

It is certified that error appears in the above-identified patent and that said Letters Patent is hereby corrected as shown below:

In the Claims:

Column 3, line 57, after "a" insert --moving--.

Signed and Sealed this

Twentieth Day of December, 1994

*Attest:*

Bruce Lehman

BRUCE LEHMAN

*Attesting Officer*

*Commissioner of Patents and Trademarks*